US010845139B2

(12) United States Patent
Bergman

(10) Patent No.: US 10,845,139 B2
(45) Date of Patent: Nov. 24, 2020

(54) BACKPLATE WITH SPRING ASSISTED GUIDE

(71) Applicant: Tech-10 Tactical, LLC, Quantico, VA (US)

(72) Inventor: Paul Bergman, Quantico, VA (US)

(73) Assignee: Tech-10 Tactical, LLC, Quantico, VA (US)

( * ) Notice: Subject to any disclaimer, the term of this patent is extended or adjusted under 35 U.S.C. 154(b) by 0 days.

(21) Appl. No.: 16/678,096

(22) Filed: Nov. 8, 2019

(65) Prior Publication Data

US 2020/0182568 A1 Jun. 11, 2020

Related U.S. Application Data

(63) Continuation-in-part of application No. 29/673,051, filed on Dec. 11, 2018, now Pat. No. Des. 894,316.

(51) Int. Cl.
*F41A 3/66* (2006.01)
*F41A 3/78* (2006.01)

(52) U.S. Cl.
CPC . *F41A 3/66* (2013.01); *F41A 3/78* (2013.01)

(58) Field of Classification Search
CPC ..... F41A 3/66; F41A 3/78; F41A 3/80; F41A 3/82; F41A 3/84; F41A 3/92; F41A 3/94; F41C 23/04
USPC ..... 89/199; 42/75.01, 75.03
See application file for complete search history.

(56) References Cited

U.S. PATENT DOCUMENTS

| | | | | |
|---|---|---|---|---|
| 9,791,229 | B1 * | 10/2017 | Cross | F41A 11/00 |
| 9,909,828 | B1 * | 3/2018 | Klein | F41A 3/66 |
| 10,663,239 | B2 * | 5/2020 | Timmons | F41A 11/02 |
| 2003/0140541 | A1 * | 7/2003 | Kay | F41C 23/22 42/72 |
| 2014/0041271 | A1 * | 2/2014 | Sanzo | F41C 23/06 42/1.06 |
| 2015/0260471 | A1 * | 9/2015 | Azhocar | F41A 11/00 42/90 |
| 2015/0308768 | A1 * | 10/2015 | Mills | F41A 35/00 42/75.03 |
| 2019/0107364 | A1 * | 4/2019 | Bergman | F41C 23/02 |

OTHER PUBLICATIONS

NPL: https://web.archive.org/web/20160713230041/https:/www.odinworks.com/Ambi_Sling_QD_Plate_p/acc-pbt-plate.htm Jul. 13, 2016.*
NPL_evidence: https://www.odinworks.com/Ambi_Sling_QD_Plate_p/acc-pbt-plate.htm.*

* cited by examiner

*Primary Examiner* — John Cooper
(74) *Attorney, Agent, or Firm* — Burr & Forman, LLP

(57) ABSTRACT

A backplate for a rifle may include a buffer tube engagement ring and an engagement tab operably coupled to the buffer tube engagement ring. The engagement tab may include a receiver engagement face and an exposed face that is opposite the receiver engagement face. The receiver engagement face may include a backplate protrusion extending away from a surface of the receiver engagement face, and a spring assisted guide spaced apart from the backplate protrusion. The spring assisted guide may include a cylindrically shaped cavity configured to receive and retain a distal end of a detent spring of the rifle.

17 Claims, 9 Drawing Sheets

BACKPLATE WITH SPRING ASSISTED GUIDE

CROSS REFERENCE TO RELATED APPLICATIONS

This application is a continuation-in-part of U.S. patent application Ser. No. 29/673,051 filed on Dec. 11, 2018, the entire contents of which are hereby incorporated by reference in their entirety.

TECHNICAL FIELD

Example embodiments generally relate to firearms and, in particular, relate to a firearm that employs a receiver end plate (or backplate) that includes a spring assisted guide.

BACKGROUND

Currently, all receiver end plates (or backplates) for the lower receiver of rifles such as the AR-15 are flawed in their design. In this regard, when attaching the buffer tube to the lower receiver, current designs for receiver end plates offer no assistance relative to retaining the takedown detent spring (or detent spring) when installing the takedown pin detent into the receiver. Instead, for a typical design, the buffer tube is threaded into the receiver with the receiver end plate already provided on the buffer tube. The buffer retainer and buffer retainer spring are installed while the buffer tube is not fully seated onto the receiver. Then, after the buffer retainer is installed and the takedown pin is inserted, and there is a relatively small gap between the end plate and the receiver, the end plate is pivoted slightly out of its installed alignment to expose the channel into which the takedown pin detent and the detent spring are to be installed. After the takedown pin detent is inserted into the channel, the detent spring follows. Thereafter, the detent spring is pushed into the channel so that the end plate can be realigned and then the buffer tube is tightened onto the receiver.

The description above, though sounding relatively simple, can often be difficult to execute particularly due to trouble retaining the detent spring. In this regard, the detent spring is small, but has to be significantly compressed during the tightening process of the buffer tube onto the receiver. During the compression, the exposed end of the detent spring can tend to wiggle around and either be unaligned with the channel (which could lead to pinching of the unaligned spring between the end plate and the receiver, or the detent spring may even be ejected from the channel. The operator typically tries to manually hold the spring in alignment with his/her thumb, while attempting to shift the end plate into alignment, and before tightening the castle nut to affix the end plate to the receiver. If the transfer between the thumb and the end plate is not just right, the detent spring may be unaligned or ejected. This can be extremely frustrating and/or time consuming and, in some cases, could lead to loss of the spring or lost time locating an ejected spring.

Thus, it may be desirable to provide an improved end plate that is designed to prevent the problems discussed above.

BRIEF SUMMARY OF SOME EXAMPLES

Some example embodiments may enable the provision of a spring assisted guide that overcomes the disadvantages described above.

In an example embodiment, a backplate for a rifle may be provided. The backplate may include a buffer tube engagement ring and an engagement tab operably coupled to the buffer tube engagement ring. The engagement tab may include a receiver engagement face and an exposed face that is opposite the receiver engagement face. The receiver engagement face may include a backplate protrusion extending away from a surface of the receiver engagement face, and a spring assisted guide spaced apart from the backplate protrusion. The spring assisted guide may include a cylindrically shaped cavity configured to receive and retain a distal end of a detent spring of the rifle.

In another example embodiment, a rifle may be provided. The rifle may include a lower receiver, a buffer tube, and a backplate. The backplate may include a buffer tube engagement ring and an engagement tab operably coupled to the buffer tube engagement ring. The engagement tab may include a receiver engagement face and an exposed face that is opposite the receiver engagement face. The receiver engagement face may include a backplate protrusion extending away from a surface of the receiver engagement face, and a spring assisted guide spaced apart from the backplate protrusion. The spring assisted guide may include a cylindrically shaped cavity configured to receive and retain a distal end of a detent spring of the rifle.

In another example embodiment, a method for assembling a backplate onto a rifle may be provided. The rifle may include a lower receiver, a buffer tube and a backplate. The backplate may include a buffer tube engagement ring and an engagement tab operably coupled to the buffer tube engagement ring. The engagement tab may include a receiver engagement face and an exposed face that is opposite the receiver engagement face. The receiver engagement face may include a backplate protrusion extending away from a surface of the receiver engagement face, and a spring assisted guide spaced apart from the backplate protrusion. The spring assisted guide may include a cylindrically shaped cavity configured to receive and retain a distal end of a detent spring of the rifle. The method may include coupling the buffer tube to the lower receiver with the backplate operably coupled to the buffer tube, providing a proximal end of the detent spring into a detent spring channel formed in the lower receiver, aligning the backplate protrusion with a cavity formed in the lower receiver and the spring assisted guide with the detent spring channel to capture the distal end of the detent spring in the spring assisted guide, compressing the detent spring in the detent spring channel by pressing the backplate to the lower receiver, and tightening a castle nut to hold the backplate in contact with the lower receiver.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
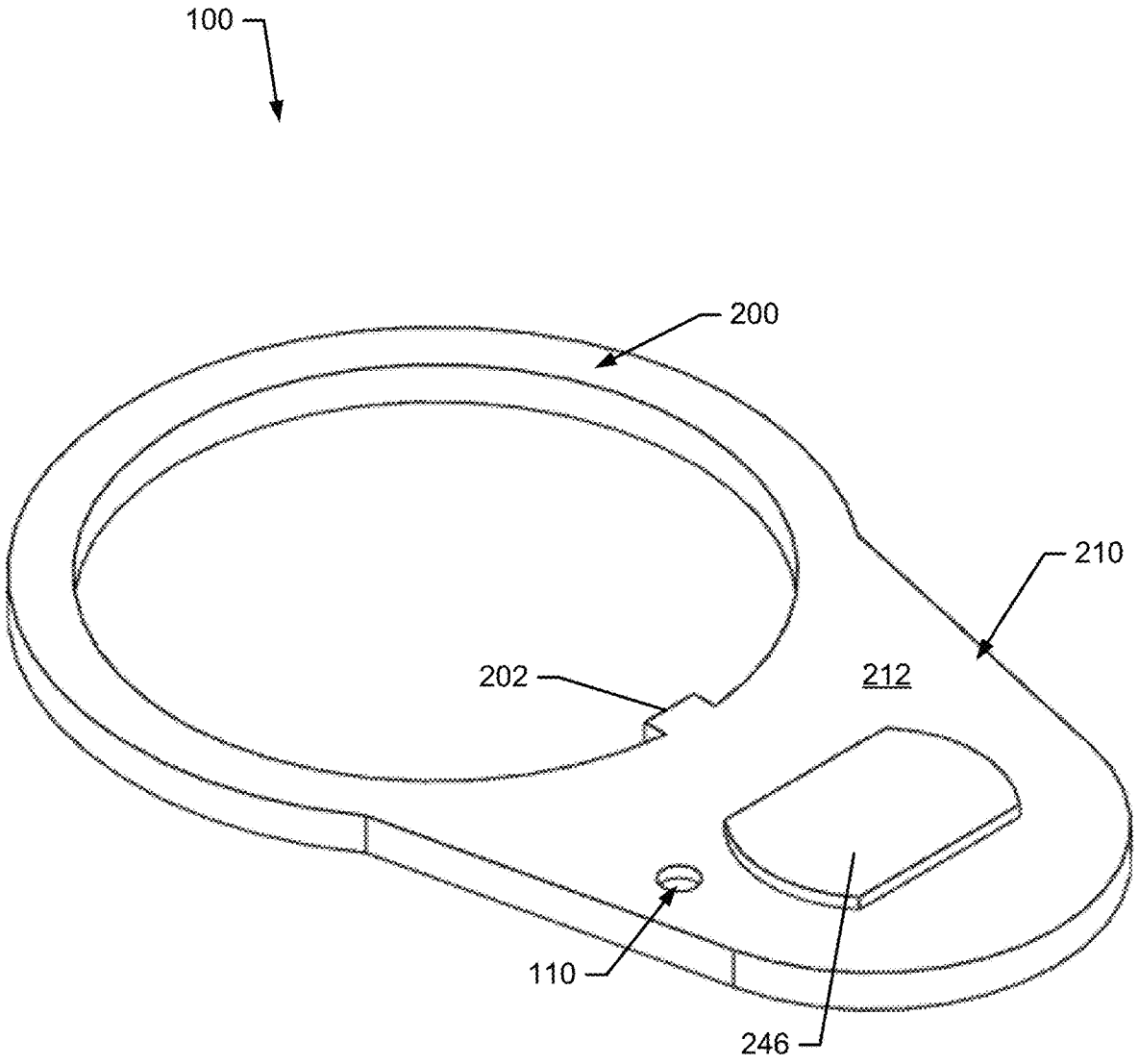
FIG. 1 is a perspective view of the front of a backplate having a spring assisted guide in accordance with an example embodiment.
Figure 2:
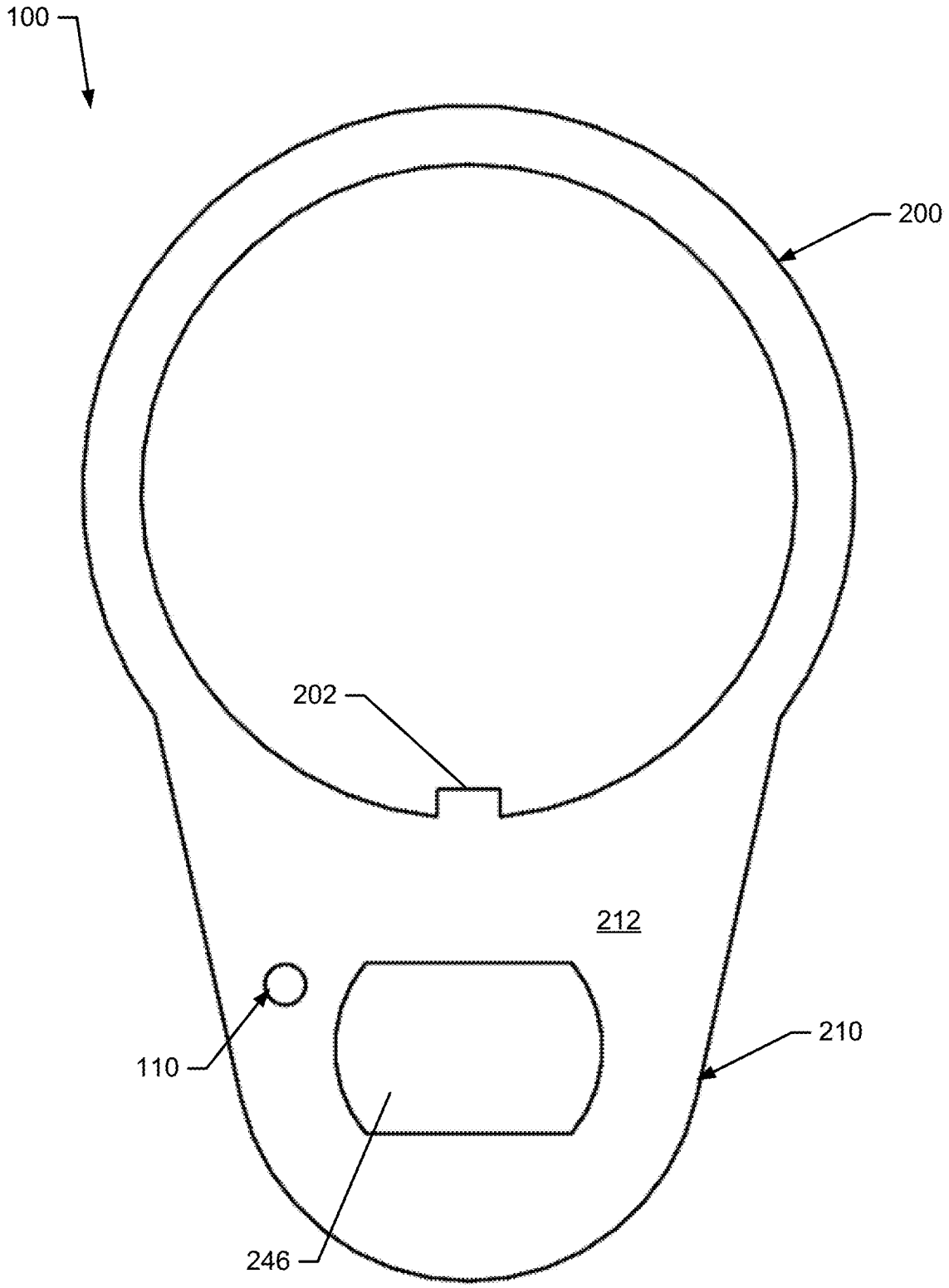
FIG. 2 is a front view of the backplate in accordance with an example embodiment.
Figure 3:
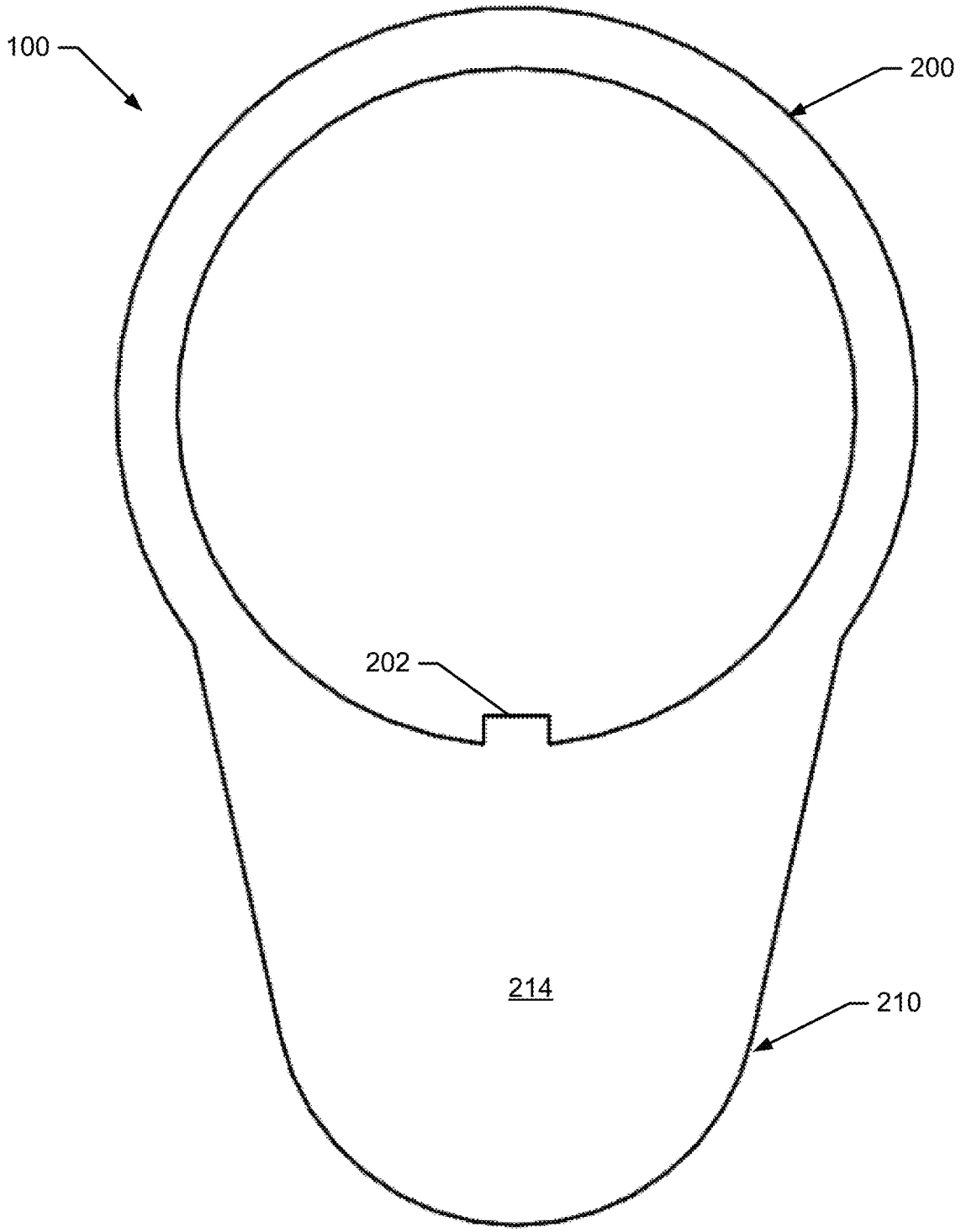
FIG. 3 is a rear view of the backplate in accordance with an example embodiment.
Figure 4:
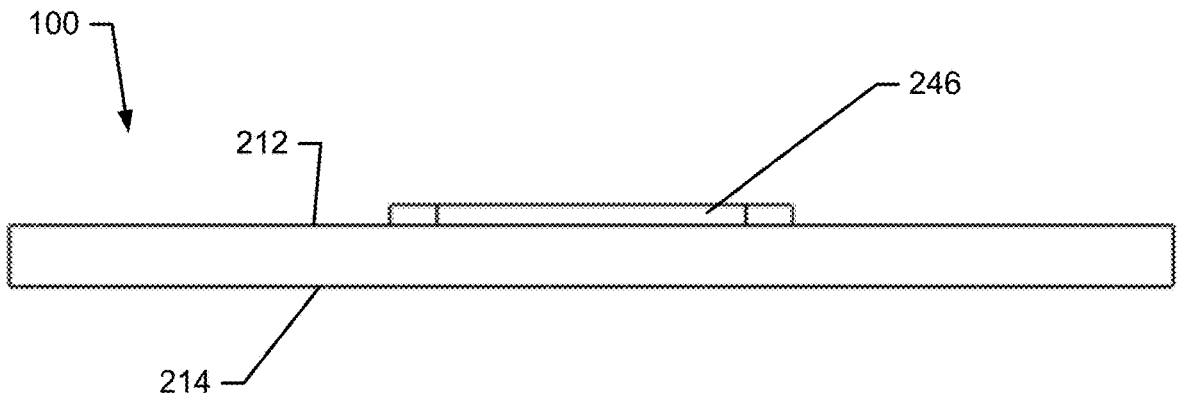
FIG. 4 is a top view of the backplate in accordance with an example embodiment.
Figure 5:
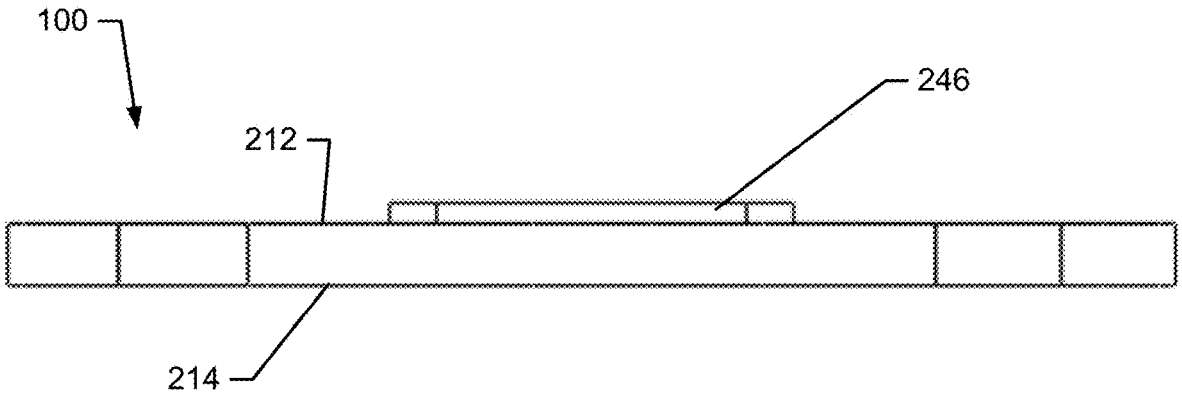
FIG. 5 is a bottom view of the backplate in accordance with an example embodiment.
Figure 6:
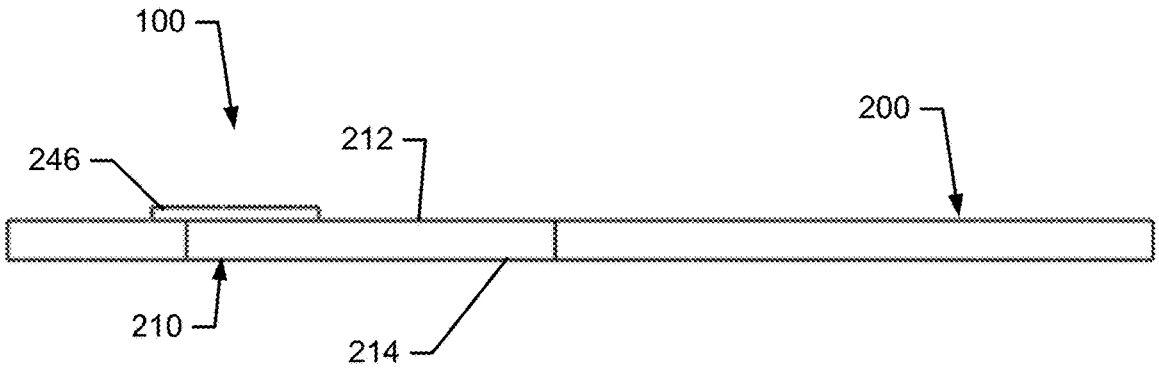
FIG. 6 is a right side view of the backplate in accordance with an example embodiment.
Figure 7:
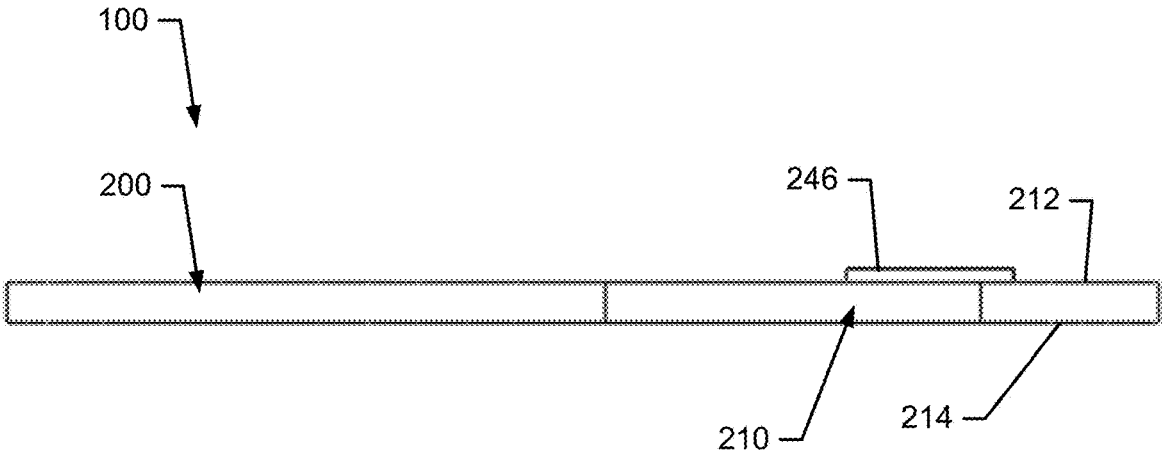
FIG. 7 is a left side view of the backplate in accordance with an example embodiment.
Figure 8:
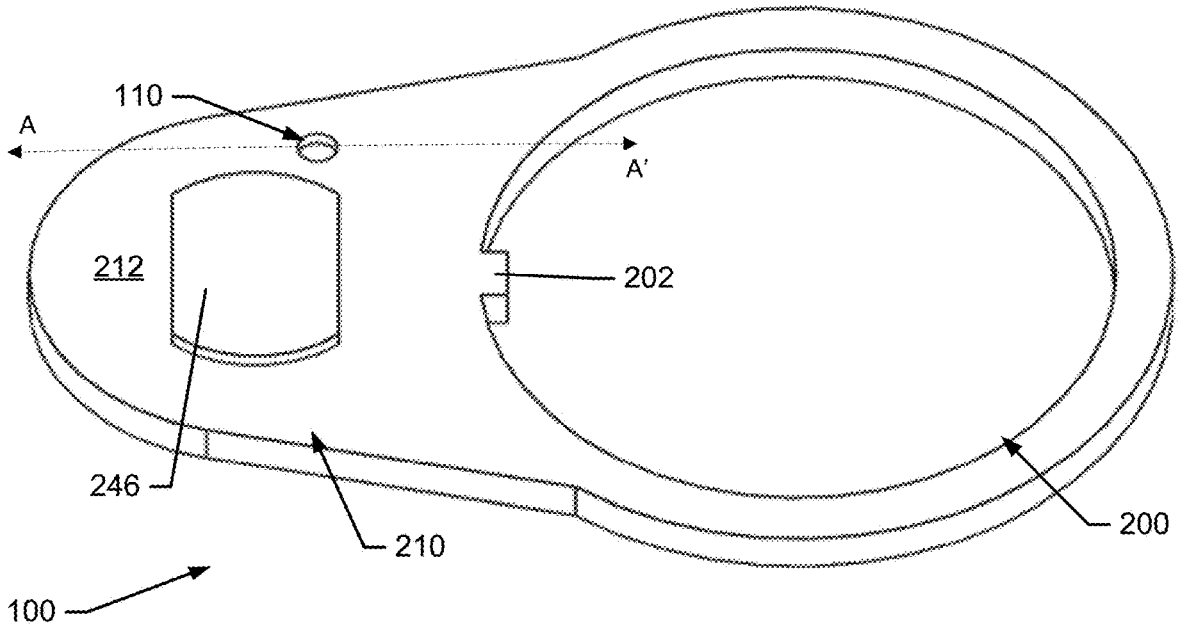
FIG. 8 is an alternative perspective view of the top of the backplate in accordance with an example embodiment.
Figure 9:
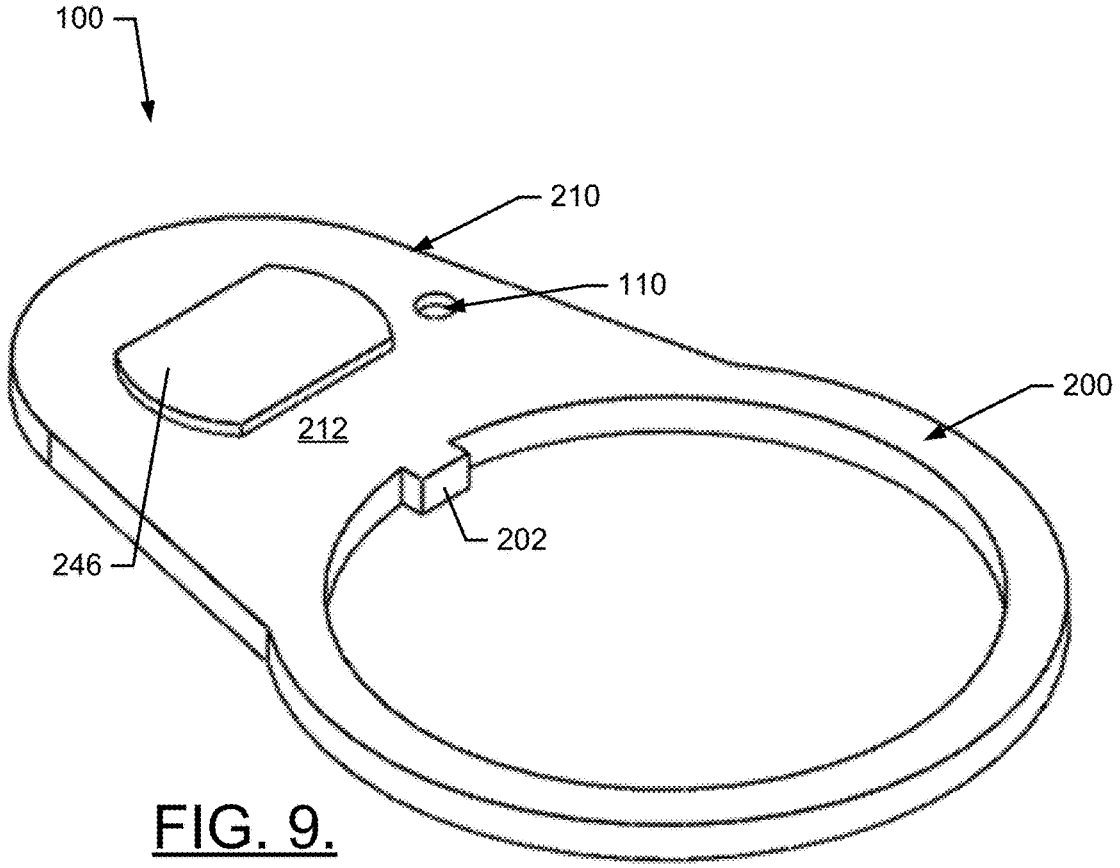
FIG. 9 is another alternative perspective view of the top of the backplate in accordance with an example embodiment.
Figure 10:
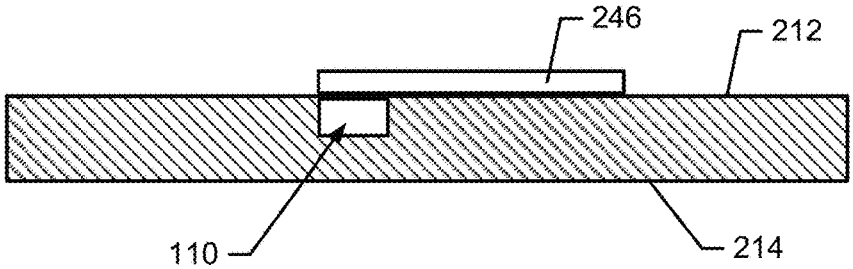
FIG. 10 is a cross sectional view of the backplate taken along line A-A' in FIG. 8.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of a receiver end plate (hereinafter referred to as a backplate 100) that includes a spring assisted guide 110 configured to overcome the disadvantages described above. FIGS. 1-10 illustrate various views of the backplate 100, and FIGS. 11-14 illustrate the backplate 100 in context relative to a lower receiver 120 and a buffer tube 130 of a rifle (e.g., an AR-15).

Referring first to FIGS. 1-14, the backplate 100 may include a buffer tube engagement ring 200 that is operably coupled to an engagement tab 210. The engagement tab 210 may include a receiver engagement face 212 and an exposed face 214 that is opposite the receiver engagement face 212. The buffer tube engagement ring 200 may be configured to extend around a threaded portion 220 of the buffer tube 130. Thus, for example, a diameter of the buffer tube engagement ring 200 may be about 1.2 inches. In an example embodiment, an alignment protrusion 202 may extend inwardly toward a center of the buffer tube engagement ring 200 from a center of a portion thereof that is adjacent to the engagement tab 210. The alignment protrusion 202 may have a width of about 0.115 inches and a depth, extending inwardly toward a center of the buffer tube engagement ring 200 of about 0.05 inches. The threaded portion 220 of the buffer tube 130 may include a slot formed in an underside thereof, and the alignment protrusion 202 may be configured to be retained in the slot.

The lower receiver 120 may include an end face 240 that may abut the receiver engagement face 212 when the buffer tube 130 has been fully assembled with the lower receiver 120. The end face 240 may include a circular receiver cavity 241 and a detent spring channel 242 inside which detent spring 244 may be provided. The detent spring channel 242 may be much smaller than the receiver cavity 241, and extend deeper into the lower receiver 120 than the receiver cavity 241. For example, the detent spring channel 242 may have diameter of about 0.0750 inches, whereas the receiver cavity 241 may have a diameter of about 0.49 inches. The exposed face 214 of the backplate 100 faces away from the end face 240, but the receiver engagement face 212 faces directly toward the end face 240. Moreover, the receiver engagement face 212 includes the spring assisted guide 110 formed therein, and a backplate protrusion 246, which extends slightly away from a surface of the receiver engagement face 212 and is configured to be inserted into the receiver cavity 241 when the backplate 100 is assembled onto the lower receiver 120 and the buffer tube 130.

In an example embodiment, the backplate protrusion 246 may extend about 0.1 inches away from the receiver engagement face 212. The backplate protrusion 246 may have a substantially circular shape (slightly smaller than a diameter of the receiver cavity 241), but may have a circular segment thereof (each of substantially the same size) removed on both the top and bottom of the backplate protrusion 246. The chord lines that result, and that form the top and bottom of the backplate protrusion 246 therefore extend parallel to each other, and may be spaced apart from each other by about 0.3132 inches. The bottom chord line (i.e., the chord line that is farthest from the buffer tube engagement ring 200) may be positioned about 0.2707 inches from the distal end of the engagement tab 210 (relative to the buffer tube engagement ring 200).

The spring assisted guide 110 may be formed as a cylindrically shaped cavity that extends substantially perpendicular to a plane in which the receiver engagement face 212 lies. In an example embodiment, a length of the backplate 100 may be about 2.1574 inches and the engagement tab 210 may extend away from the alignment protrusion 202 over the last about 0.85 inches of the backplate 100 extending away from the buffer tube engagement ring 200. The cylindrical cavity that forms the spring assisted guide 110 may be machined into the surface of the receiver engagement face 212 at a portion thereof that lies in alignment with the detent spring channel 242 when the backplate 100 is fully installed with the lower receiver 120 and abuts the end face 240. Thus, for example, the cavity that forms the spring assisted guide 110 may have a depth of about 0.025 inches from the surface of the receiver engagement face 212.

In an example embodiment, the diameter of the detent spring channel 242 may also be about 0.025 inches, and a diameter of the detent spring 244 may be slightly less than 0.025 inches to provide a relatively tight fit for the detent spring 244 within the detent spring channel 242, and also for an end portion of the detent spring 244 within the spring assisted guide 110. The outer diameter of the top of the spring assisted guide 110 may be at substantially the same elevation as the top chord line that demarcates the top of the backplate protrusion 246. Moreover, the center of the spring assisted guide 110 may be located about 0.04 inches below the top chord line and 0.09093 inches spaced apart from a maximum lateral extent of a peripheral edge of the backplate protrusion 246. Thus, a center of the backplate protrusion 246 may be farther away from the buffer tube engagement ring 200 than a center of the spring assisted guide 110.

Figure 11:
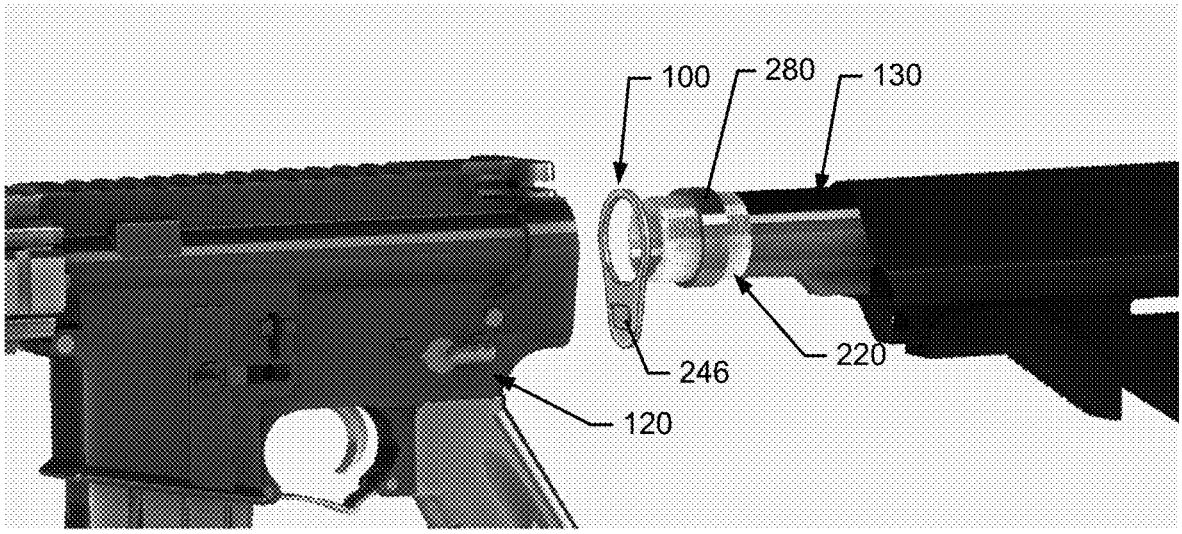
FIG. 11 is an exploded, front perspective view of the backplate between a receiver and a buffer tube in accordance with an example embodiment.
Figure 12:
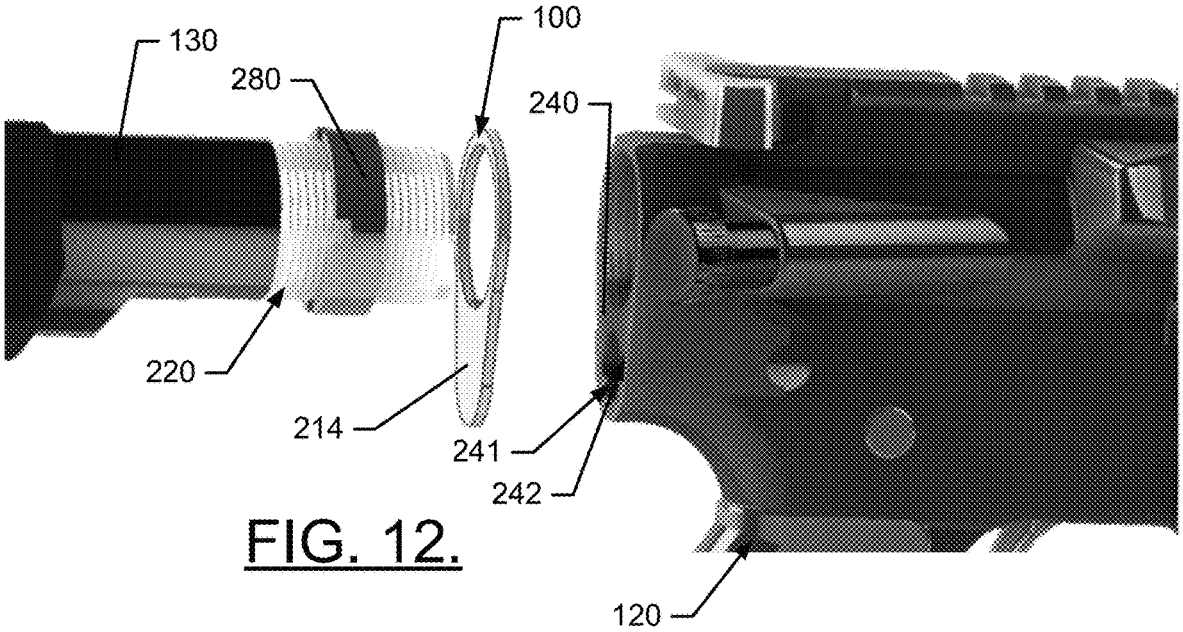
FIG. 12 is an exploded, rear perspective view of the backplate between the receiver and the buffer tube in accordance with an example embodiment.
Figure 13:
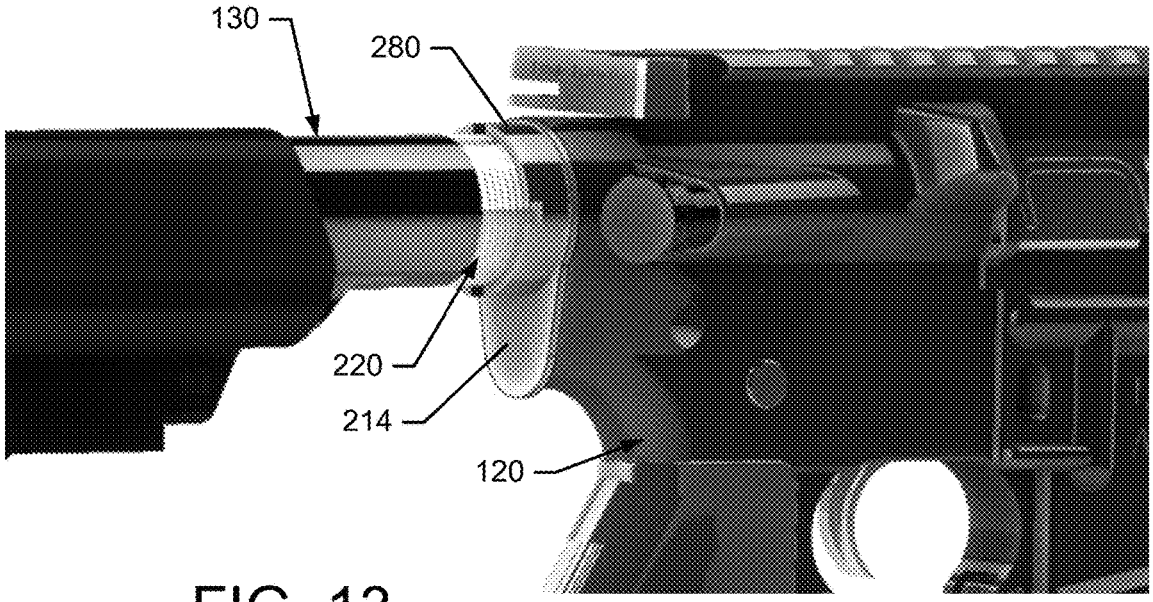
FIG. 13 is an assembled, rear perspective view of the backplate attached to the receiver in accordance with an example embodiment.
Figure 14:
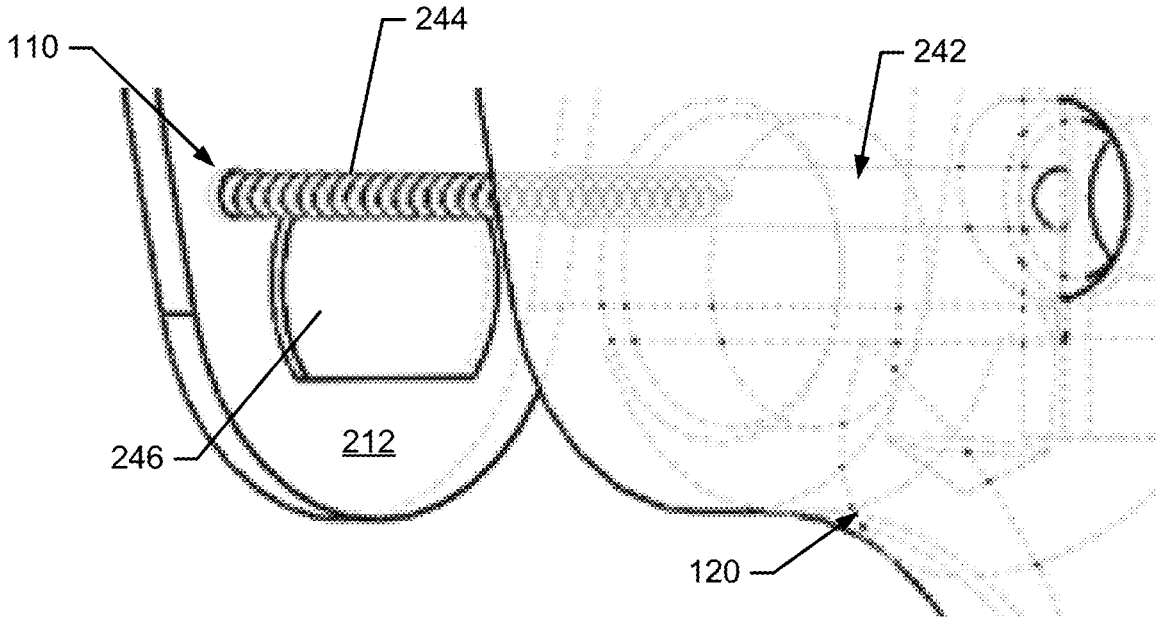
FIG. 14 is a rear perspective view with internal components of the receiver shadowed in accordance with an example embodiment.

During assembly, the backplate 100 may be positioned between the lower receiver 120 and the buffer tube 130 as shown in FIGS. 11 and 12. Of note, castle nut 280 may already be partially threaded onto the threaded portion 220 of the buffer tube 130. The backplate 100 may be positioned such that the receiver engagement face 212 faces the end face 240 of the lower receiver 120, and the exposed face 214 faces toward the buffer tube 130. The backplate 100 may then be slid onto the threaded portion 220 to engage the castle nut 280 and the buffer tube 130 may be threaded partially into the lower receiver 120. Leaving a gap between the end face 240 and the receiver engagement face 212 (and perhaps turning the buffer tube 130 slightly to move the backplate 100 out of the way of the detent spring channel 242), a proximal end of the detent spring 244 may be inserted into the detent spring channel 242. A distal end of the detent spring 244 may then be inserted into the spring assisted guide 110 as shown in FIG. 14. If the buffer tube 130 had been rotated slightly, the buffer tube 130 may now be rotated back into a position where the receiver cavity 241 and backplate protrusion 246 are in alignment with each other, and the spring assisted guide 110 and the detent spring channel 242 are also substantially aligned with each other. The spring assisted guide 110 may then hold the distal end of the detent spring 244 in alignment with the detent spring channel 242 as the backplate 100 is pushed toward the lower receiver 120. The holding of the distal end of the detent spring 244 during this compression allows the detent spring 244 to be compressed while remaining properly aligned and completely avoids the problems discussed above. When the backplate 100 contacts the lower receiver 120 (and the backplate protrusion 246 is seated within the receiver cavity 241), the castle nut 280 may be tightened to affix the backplate 100 to the lower receiver 120 such that the receiver engagement face 212 is in contact with the end face 240.

As can be appreciated from the description above, the location and shape of the spring assisted guide 110 are of key importance relative to addressing the problems mentioned herein. In this regard, the shape (e.g., depth and diameter) of the spring assisted guide 110 enables the distal end of the detent spring 244 to be captured and retained therein, and the location (i.e., aligned with the detent spring channel 242 when the backplate 100 is properly aligned with the lower receiver 120) enables the captured distal end of the detent spring 244 to be aligned with the portion of the detent spring 244 that is initially disposed in the detent spring channel 242. Accordingly, as the backplate 100 is moved toward the lower receiver 120 for tightening of the castle nut 280, the detent spring 244 will not need to be retained by the fingers of the installer, and the possibility of losing or fumbling over the detent spring 244 during assembly will be substantially reduced or even eliminated.

Thus, according to an example embodiment, embodiment, a rifle may be provided. The rifle may include a lower receiver, a buffer tube, and a backplate. The backplate may include a buffer tube engagement ring and an engagement tab operably coupled to the buffer tube engagement ring. The engagement tab may include a receiver engagement face and an exposed face that is opposite the receiver engagement face. The receiver engagement face may include a backplate protrusion extending away from a surface of the receiver engagement face, and a spring assisted guide spaced apart from the backplate protrusion. The spring assisted guide may include a cylindrically shaped cavity configured to receive and retain a distal end of a detent spring of the rifle.

In some cases, the rifle (or the backplate) described above may be augmented or modified by altering individual features mentioned above or adding optional features. The augmentations, alternations or modifications may be performed in any combination and in any order. For example, in some cases, the cylindrically shaped cavity of the spring assisted guide may have a diameter of about 0.075 inches, and a depth of about 0.025 inches from the surface of the receiver engagement face. In an example embodiment, the engagement tab may have a depth of 0.075 inches, the backplate protrusion may be configured to fit into a cavity formed at an end face of the lower receiver of the rifle when the backplate is assembled onto the rifle, and the cavity may be proximate to a detent spring channel formed at the end face of the lower receiver. In some cases, the spring assisted guide may be disposed at a portion of the receiver engagement face that aligns with the detent spring channel when the backplate is assembled onto the rifle. In an example embodiment, the buffer tube engagement ring may be configured to extend around a threaded portion of a buffer tube of the rifle, the threaded portion may include a slot, and the buffer tube engagement ring may include an alignment protrusion extending inwardly toward a center of the buffer tube engagement ring to interface with the slot to facilitate alignment of the backplate protrusion with the cavity and of the detent spring channel with the spring assisted guide when the backplate is assembled onto the rifle. In some cases, responsive to insertion of a proximal end of the detent spring into the detent spring channel, and alignment of the detent spring channel with the spring assisted guide, the distal end of the detent spring is received and retained in the spring assisted guide. In an example embodiment, the spring assisted guide may be spaced apart from the backplate protrusion by at least 0.09 inches. In some cases, a center of the backplate protrusion may be farther away from the buffer tube engagement ring than a center of the spring assisted guide.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A backplate for a rifle, the backplate comprising:

a buffer tube engagement ring; and an engagement tab operably coupled to the buffer tube engagement ring, wherein the engagement tab comprises a receiver engagement face and an exposed face that is opposite the receiver engagement face, wherein the receiver engagement face comprises a backplate protrusion extending away from a surface of the receiver engagement face, and a spring assisted guide spaced apart from the backplate protrusion, and wherein the spring assisted guide comprises a cylindrically shaped cavity configured to receive and retain a distal end of a detent spring of the rifle.

2. The backplate of claim 1, wherein the cylindrically shaped cavity of the spring assisted guide has a diameter of about 0.075 inches, and a depth of about 0.025 inches from the surface of the receiver engagement face.

3. The backplate of claim 2, wherein the engagement tab has a depth of 0.075 inches, wherein the backplate protrusion is configured to fit into a cavity formed at an end face of a lower receiver of the rifle when the backplate is assembled onto the rifle, and wherein the cavity is proximate to a detent spring channel formed at the end face of the lower receiver.

4. The backplate of claim 2, wherein the spring assisted guide is disposed at a portion of the receiver engagement face that aligns with the detent spring channel when the backplate is assembled onto the rifle.

5. The backplate of claim 4, wherein the buffer tube engagement ring is configured to extend around a threaded portion of a buffer tube of the rifle, wherein the threaded portion comprises a slot, wherein the buffer tube engagement comprises an alignment protrusion extending inwardly toward a center of the buffer tube engagement ring to interface with the slot to facilitate alignment of the backplate protrusion with the cavity and of the detent spring channel with the spring assisted guide when the backplate is assembled onto the rifle.

6. The backplate of claim 4, wherein responsive to insertion of a proximal end of the detent spring into the detent spring channel, and alignment of the detent spring channel with the spring assisted guide, the distal end of the detent spring is received and retained in the spring assisted guide.

7. The backplate of claim 1, wherein the spring assisted guide is spaced apart from the backplate protrusion by at least 0.09 inches.

8. The backplate of claim 7, wherein a center of the backplate protrusion is farther away from the buffer tube engagement ring than a center of the spring assisted guide.

9. A rifle comprising:

a lower receiver;

a buffer tube; and a backplate comprising:

a buffer tube engagement ring; and an engagement tab operably coupled to the buffer tube engagement ring, wherein the engagement tab comprises a receiver engagement face and an exposed face that is opposite the receiver engagement face, wherein the receiver engagement face comprises a backplate protrusion extending away from a surface of the receiver engagement face, and a spring assisted guide spaced apart from the backplate protrusion, and wherein the spring assisted guide comprises a cylindrically shaped cavity configured to receive and retain a distal end of a detent spring of the rifle.

10. The rifle of claim 9, wherein the cylindrically shaped cavity of the spring assisted guide has a diameter of about 0.075 inches, and a depth of about 0.025 inches from the surface of the receiver engagement face.

11. The rifle of claim 10, wherein the engagement tab has a depth of 0.075 inches, wherein the backplate protrusion is configured to fit into a cavity formed at an end face of the lower receiver of the rifle when the backplate is assembled onto the rifle, and wherein the cavity is proximate to a detent spring channel formed at the end face of the lower receiver.

12. The rifle of claim 11, wherein the spring assisted guide is disposed at a portion of the receiver engagement face that aligns with the detent spring channel when the backplate is assembled onto the rifle.

13. The rifle of claim 12, wherein the buffer tube engagement ring is configured to extend around a threaded portion of a buffer tube of the rifle, wherein the threaded portion comprises a slot, wherein the buffer tube engagement comprises an alignment protrusion extending inwardly toward a center of the buffer tube engagement ring to interface with the slot to facilitate alignment of the backplate protrusion with the cavity and of the detent spring channel with the spring assisted guide when the backplate is assembled onto the rifle.

14. The rifle of claim 12, wherein responsive to insertion of a proximal end of the detent spring into the detent spring channel, and alignment of the detent spring channel with the spring assisted guide, the distal end of the detent spring is received and retained in the spring assisted guide.

15. The rifle of claim 9, wherein the spring assisted guide is spaced apart from the backplate protrusion by at least 0.09 inches.

16. The rifle of claim 15, wherein a center of the backplate protrusion is farther away from the buffer tube engagement ring than a center of the spring assisted guide.

17. A method for assembling a backplate onto a rifle, the rifle comprising a lower receiver, a buffer tube and a backplate, the backplate comprising a buffer tube engagement ring and an engagement tab operably coupled to the buffer tube engagement ring, the engagement tab comprising a receiver engagement face and an exposed face that is opposite the receiver engagement face, wherein the receiver engagement face comprises a backplate protrusion extending away from a surface of the receiver engagement face, and a spring assisted guide spaced apart from the backplate protrusion, and wherein the spring assisted guide comprises a cylindrically shaped cavity configured to receive and retain a distal end of a detent spring of the rifle, the method comprising:

coupling the buffer tube to the lower receiver with the backplate operably coupled to the buffer tube;

providing a proximal end of the detent spring into a detent spring channel formed in the lower receiver;

aligning the backplate protrusion with a cavity formed in the lower receiver and the spring assisted guide with the detent spring channel to capture the distal end of the detent spring in the spring assisted guide;

compressing the detent spring in the detent spring channel by pressing the backplate to the lower receiver; and tightening a castle nut to hold the backplate in contact with the lower receiver.

* * * * *